United States Patent [19]

Stevenson

[11] 4,364,323

[45] Dec. 21, 1982

[54] VERTICAL STRESSED MOORING TETHER IN A FLOATING OIL PLATFORM

[75] Inventor: William D. Stevenson, Edinburgh, Scotland

[73] Assignee: Vickers Limited, London, England

[21] Appl. No.: 226,758

[22] Filed: Jan. 21, 1981

[30] Foreign Application Priority Data

Jan. 26, 1980 [GB] United Kingdom ..... 8002685

[51] Int. Cl.[3] ..... B63B 21/52

[52] U.S. Cl. ..... 114/265; 114/230; 405/195

[58] Field of Search ..... 114/205, 230, 264, 265; 405/195; 175/5; 166/539; 254/29 R; 9/8 P

[56] References Cited

U.S. PATENT DOCUMENTS

| | | | |
|---|---|---|---|
| 3,540,396 | 11/1970 | Horton | 114/265 |
| 3,563,042 | 2/1971 | Ryan | 114/265 |
| 3,943,868 | 3/1976 | Person et al. | 114/264 |
| 4,215,950 | 8/1980 | Stevenson | 114/264 |

*Primary Examiner*—Trygve M. Blix
*Assistant Examiner*—Jesus D. Sotelo
*Attorney, Agent, or Firm*—Larson and Taylor

[57] ABSTRACT

A floating platform intended to be anchored to the sea bed incorporates a substantially vertical tether. The tether is fitted with a gas-operated tension spring device capable of generating an elastic tensile force in the tether. Means is provided for varying the nominal tensile force which the spring device is capable of exerting. The tether may include an adjustor nut movable along a screw-threaded portion of the tether so as to be engageable with an adjustor nut adaptor supported by the platform.

6 Claims, 6 Drawing Figures

VERTICAL STRESSED MOORING TETHER IN A FLOATING OIL PLATFORM

This subject of this invention is a stressed mooring tether for mooring a floating oil platform.

It has been the practice to moor floating oil platforms by splayed mooring cables each of which assumes roughly the form of a catenary curve but said moorings have serious shortcomings in that they permit the platform to rise and fall and oscillate with tide and wave action and also permit some degree of drift. There has now been developed a mooring comprising spaced vertical rigid or flexible tethers each anchored at one end to the sea bed directly below the platform and anchored at the top end to the platform itself. The tethers are arranged to hold the platform at a level below its natural floating level whereby to eliminate or reduce to a chosen amount vertical buoyant movement of the platform. The tethers are therefore under tensile stress. The stress is provided and maintained by the upthrust of the water on the buoyancy members of the platform when the platform is below its normal buoyancy level and is generated in the tether by applying a force between the tether and the platform whereby to cause the platform to move downwardly with respect to the tether so that the tether is put under tensile stress in providing the reaction to the force pushing the platform downwards against its own buoyancy. A rigid tether normally comprises several rigid tubular sections including a topmost and a lowermost section and several intermediate sections fastened end to end. A flexible tether normally comprises a wire rope.

Such tension tethers present the advantage of holding the platform almost motionless against vertical and sideward movement and oscillation in spite of tidal rise and fall and wave motion.

Heretofore there has always been danger present during the operation of installing tensioned mooring tethers and adjusting them to hold the platform at the desired distance below its natural floating level because in most locations, the North Sea is an example, the water is practically never still so that a platform while being moored is continually rising and falling, rolling and pitching and oscillating and it is thus quite impossible to decide on a datum position for the platform to be used as a basis for making the necessary adjustment at the connection of the vertical mooring tether at the platform to cause the platform to be depressed far enough below its natural floating level to become stationary or substantially stationary in all conditions against the buoyancy forces trying to move it vertically without there ever being generated in the tethers stresses higher than those which the tethers can safely bear.

The devices customarily used for making the adjustments in the connections of the tethers to the platforms are screw jacks and hydraulic jacks because considerable tensile stresses arise in the tethers when the platform is depressed. The element of danger occurs during the act of depressing the platform to the vertical position where movement of the platform is suppressed or reduced to the desired extent. This is because screw and hydraulic jacks and any other screw and hydraulic devices which may be attached between the tethers and the platform to force the platform downwardly with respect to the tether provide an inelastic thrusting force. The result is that during sea movement as the platform drops below the position to which the jacks have pushed it at any instant during the action of depressing the platform and rises on the following upward movement it delivers a hammer blow to the tether when it suddenly meets the rigid restraint imposed by the screw or hydraulic jack or other inelastic device. It is possible during the sudden arrest of upward movement of the platform to generate transient stresses in the tethers well above their safe limits of stress.

It is an object of the present invention to provide a mooring tether for mooring a floating oil platform to an anchorage on the sea bed incorporating a vertical mooring tether member and means arranged to move the platform downwardly with respect to the tether while maintaining controlled conditions of stress in the tether under all conditions. It is also an object of the invention to provide a mooring tether which when mooring a platform in its desired vertical position is stressed to a loading just sufficient to maintain the desired extent of platform movement without ever overstressing the tether. It is also an object of the invention to provide a vertical mooring tether for mooring a floating oil platform to an anchorage which, during the operation of establishing the correct relative position of the platform and the anchorage, provides that the platform has a desired maximum extent of vertical movement and controlled conditions of stress in the tether are maintained throughout the operation.

The desired extent of platform movement may be zero movement.

According to the invention a mooring tether arranged to be connected between a floating oil platform and an anchorage on the the sea bed incorporates a gas-operated tension spring device capable of generating an elastic tensile force in the tether and means for varying the nominal tensile force which the spring device is capable of exerting.

Means may be provided for varying the rate of the tension spring device, i.e. the ratio between the tensile force exerted by the device and any particular extended length of the device.

Also according to the invention a method of providing a tether for mooring a floating oil platform so that the platform remains within a desired range of vertical movement incorporating a substantially vertical tether member comprises attaching the tether between the platform and an anchorage on the sea bed, generating by means of a gas-operated tension spring device an elastic tensile force in the tether member sufficient to cause the platform to be depressed to a position vertically below its naturally free floating position until the vertical movement of the platform has been brought within the desired range, then holding the platform to the tether in that position.

The method may include the step of removing the gas-operated tension spring device after the platform is in the desired position.

The mooring tether may incorporate a tether member fitted at one end with a connector arranged to be connected to the anchorage on the sea bed and at the other end with a screw-threaded section on which an adjustor nut is movable, an adjustor nut adaptor surrounding the screw-threaded section and being supported on the platform, the gas-operated tension spring device being connected between the upper end of the screw-threaded section and the platform.

In an alternative construction the mooring tether may incorporate a tether member fitted at one end with a connector connected at one end to the anchorage on the sea bed and at the other end with a fixed abutment between which and the platform there is interposed at least one variable spacer device capable of maintaining a chosen spaced relationship between the top of the tether member and the platform and the gas-operated tension spring device being connected between the upper end of the tether member and the platform.

The variable spacer device may be a turnbuckle device.

The gas-operated tension spring device may incorporate an operating cylinder within which a piston is slidable, the piston being connected to a piston rod projecting from the cylinder and connected to the upper end of the tether member, at least one accumulator cylinder in communication with the end of the cylinder from which the piston rod projects, said end of the operating cylinder being filled with operating liquid and the accumulator cylinder also containing operating liquid, valve means controlling the flow of operating liquid between the operating cylinder and the accumulator cylinder and a source of gas supply at a pressure above atmospheric and of finite volume connected to the part of the accumulator cylinder above liquid level so that the gas pressure is applied to the upper surface of the operating liquid in said accumulator cylinder and thus to the liquid in the operating cylinder.

The gas supply may be divided into a high pressure gas supply and a low pressure gas supply alternatively connectible to the accumulator cylinder.

The gas pressure may be varied by arranging that the gas supply is from several pressurized bottles each separately connectible to the accumulator cylinder. Alternatively the accumulator cylinder may be connected to a number of bottles all connected by individual valve means to a common gas line leading to the accumulator cylinder so that a chosen number of bottles may be put in communication with the accumulator cylinder.

Normally a floating oil platform is of rectangular shape and is tethered at each corner, the tethering action at each corner being normally provided by several mooring tethers the number and strength of which are such that failure of at least one of the tethers at any corner does not put the platform in danger.

In the accompanying drawings.

Figure 3:
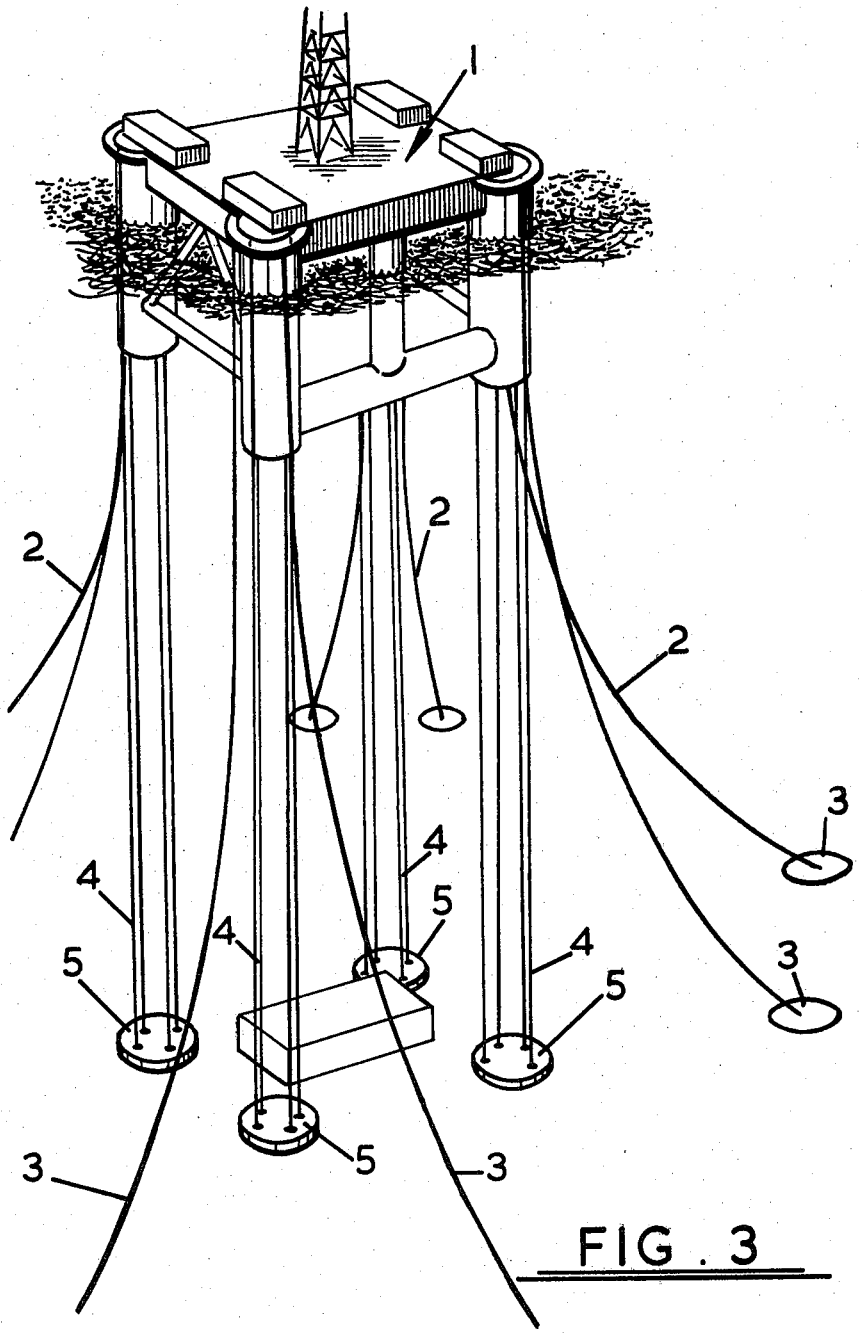
Figure 4:
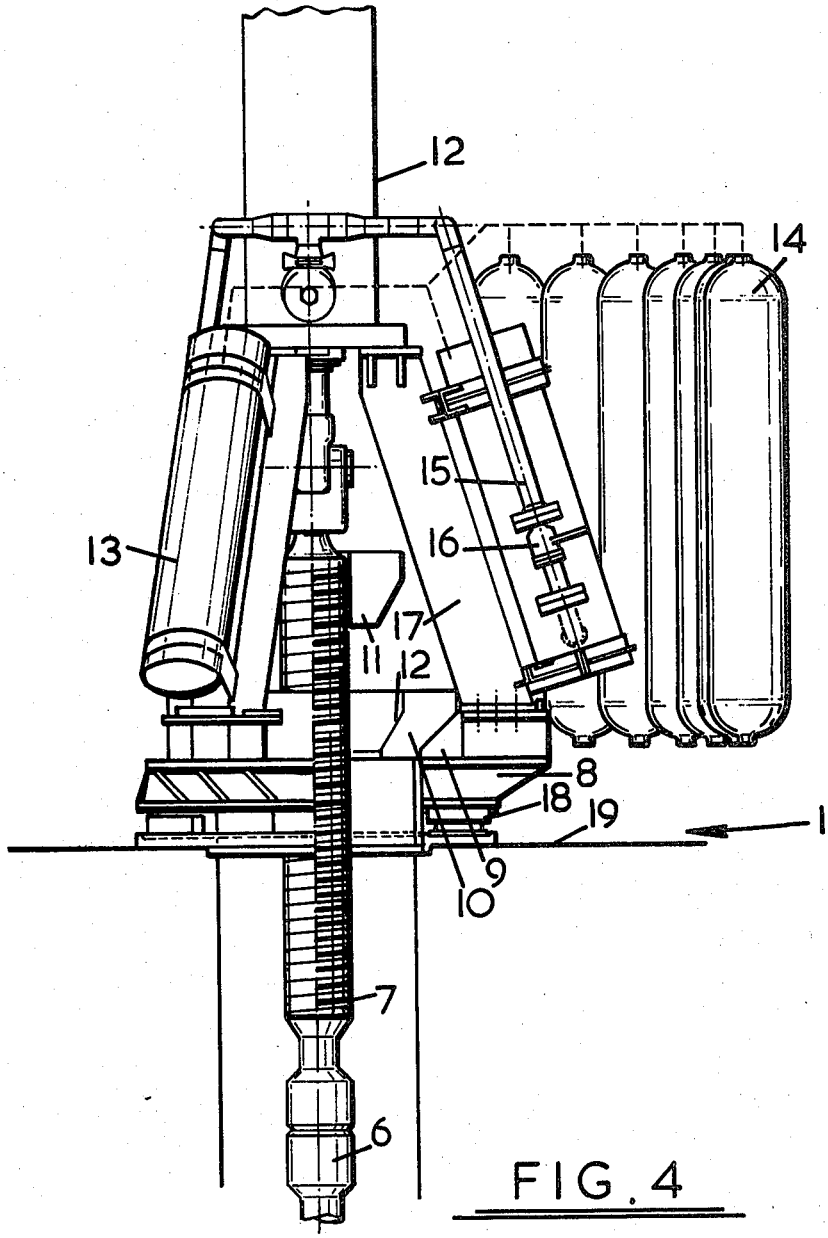
Figure 5:
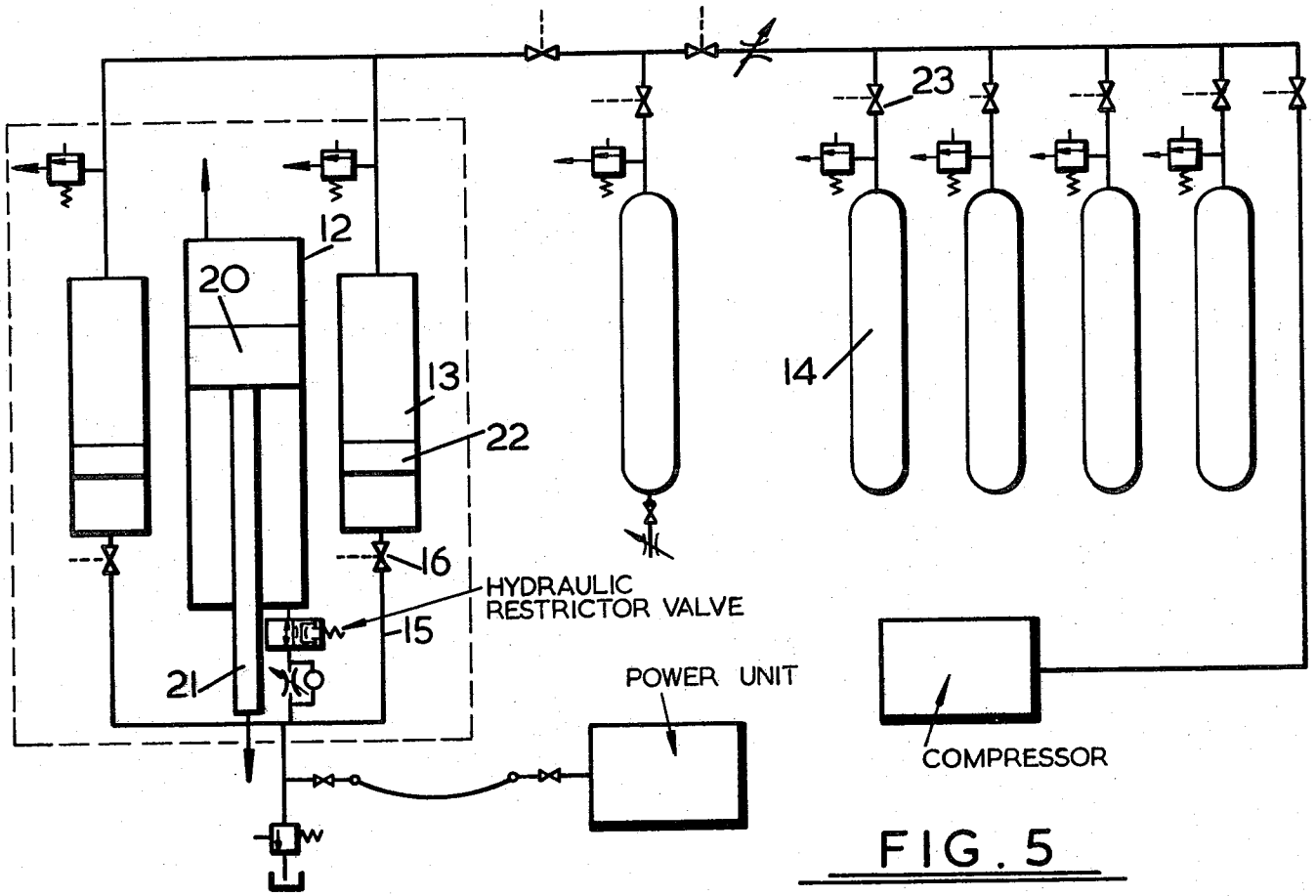
Figure 6:
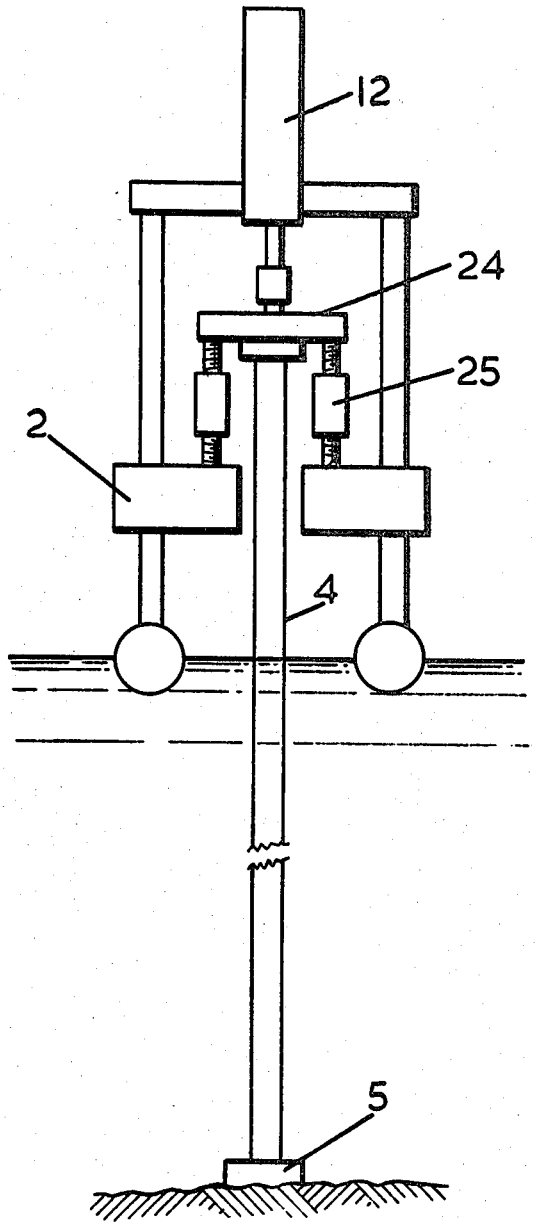

FIG. 3 illustrates a floating platform showing mooring cables attached to the platform as a temporary mooring and also vertical tethers in place as permanent moorings, FIG. 4 illustrates the top end of a tether showing one construction of the various parts which provide for the fitment of the tether and the tensioning of the tether, FIG. 5 shows diagrammatically a tensioning device and its liquid and gas circuits and FIG. 6 shows an alternative method of attaching a tether to a platform.

Figure 1:
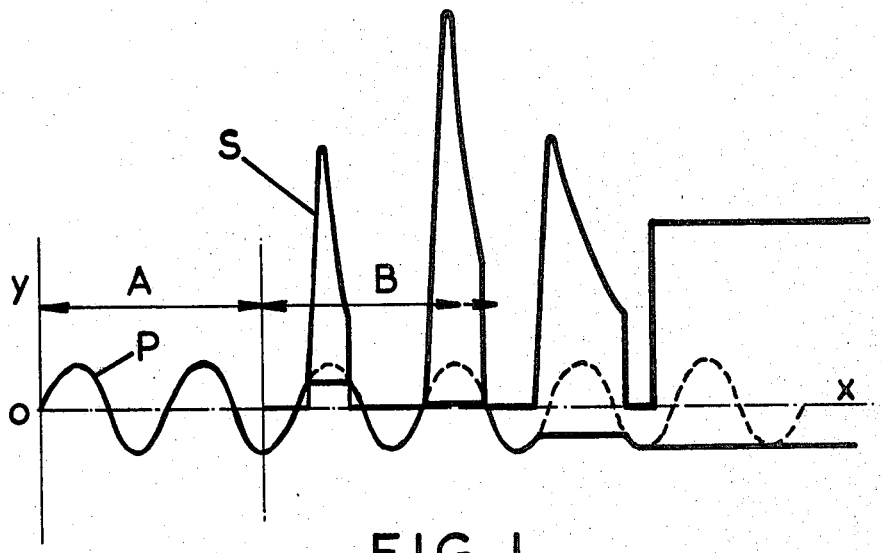
FIG. 1 is a graph showing the manner of operation of existing apparatus for providing a stressed mooring tether in a floating oil platform.

Referring to FIG. 1 the x axis denotes time and y axis denotes vertical displacement from the mean sea level represented by zero on the y axis. The curve P indicates graphically movement of the platform. The portion A of the curve P denotes the uncontrolled movement of the platform before the vertical mooring tethers are rendered operative and the portion B of the graph indicates the action during shortening of the tethers by use of screw jacks or hydraulic jacks. The substantially flat tops on the upwardly convex portions of the graph indicate the sudden arrest of the platform as it comes against the rigid restraint imposed by the screw or hydraulic jacks as the platform moves upwards. At these sudden arrest points the vertical tethers have to absorb the momentum of the platform and the upthrust of the water moving the platform upwards. As the force generated in bringing an object to rest is a function of the rate of change of momentum the stresses generated in the tether during the very rapid deceleration of the platform when its upward movement is halted can be very high indeed as is indicated by the spikes on the curve S in the graph. The curve S represents the stress in the tether. Such stresses can easily exceed the yield strength of the tethers. Even when the tethers do not fail completely they may be strained permanently and may consequently remain in a weakened condition.

Figure 2:
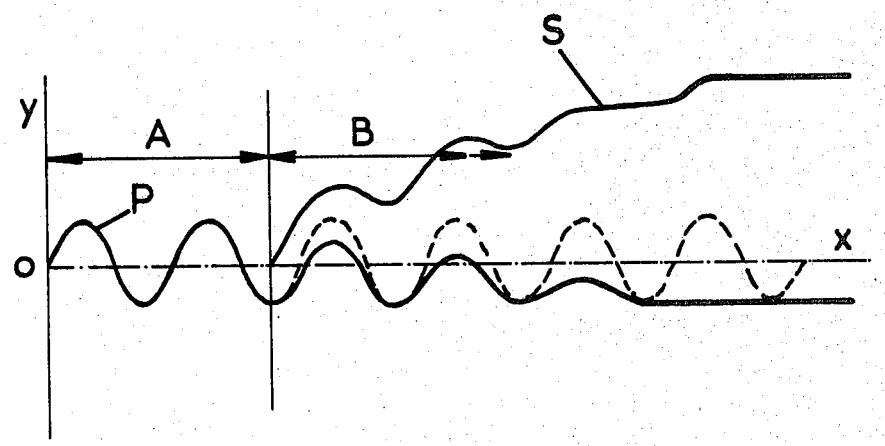
FIG. 2 is a graph showing the mode of operation of the present invention.

With reference to FIG. 2, as in FIG. 1 the axis x denotes time and the axis y denotes vertical displacement of the platform, the curve P denotes movement of the platform and the curve S represents stress in the tether. It will be seen that even during the action of bringing the upward movement of the platform to rest (portion B of the curve) the lower elevations of the crests indicating the reducing downward movement are rounded denoting a gradual deceleration and a much longer time spent in bringing the platform to rest. By adjustment of the gas-operated tension spring it is easy to arrange that the stresses generated during deceleration do not exceed the static force necessary to hold the platform in the desired depressed position. Excessive stresses are thus never generated in the mooring tethers by the method and apparatus of the invention.

In FIG. 3 of the drawings 1 denotes a platform to which are connected flexible cables 2 anchored at 3 on the sea bed. The cables 2 assume the form of catenary curves and act as temporary moorings for the platform to enable the permanent tether moorings to be put in place. 4 denotes the permanent tether moorings the lower ends of which are connected to anchorages 5 on the sea bed. The tethers 4 are duplicated at the corners of the platform 1 to provide a degree of redundancy and are designed to provide an anchoring force such that failure of a tether still leaves adequate anchoring effort from the remaining tethers.

Referring to FIG. 4, 6 denotes an uppermost tether section and 7 denotes an adjustor element coupled to the upper end of the tether section 6 and formed with a screw thread. The lowermost end of the tether presents means for engaging a connector provided in the anchorage 5 on the sea bed. The form of connection is not the subject of this proposal and need not be illustrated. 8 denotes a load base supported on the platform 1 surrounding the adjustor element 7, 9 denotes a locking collar resting on the load base 8 and 10 denotes an adjusting nut adaptor supported by the locking collar 9. 11 denotes an adjustor nut fitted to the screw-threaded portion of the adjustor section 7 and arranged to engage a seat in the adjustor nut adaptor 10. 12 denotes the operating cylinder of a gas-operated tension spring device connected by a coupling to the adjustor section 7. 13 denotes accumulators connected to gas bottles 14 constituting a supply of high pressure and low pressure gas to the accumulators 13, said accumulators 13 containing operating liquid arranged to be pressed by the gas in the gas bottles 14, liquid in the accumulators 13 having access to the underside of a piston slidable in the operating cylinder 12 of the spring device by means of conduits 15 whereby to provide a lifting force on the tether 4. Each conduit 15 contains a shut-off valve 16. 17 denotes support legs supporting the operating cylinder 12 of the gas-operated spring device. 18 denotes load cells interposed between the load base 8 and a supporting surface 19 of the platform 1.

With reference to FIG. 5 the operating cylinder 12 of the gas-operated tension spring device contains a piston 20 coupled by a piston rod 21 to the screw-threaded section 7. The accumulators 13 contain free pistons 22 and the portions below the pistons 22 form a space filled with operating liquid, the cylinders 12 and 13 being in communication with one another by way of the conduit 15 containing the shut-off valve 16. The portions of the cylinders 13 above the pistons 22 are connected to the gas bottles 14 each controlled by a separate control valve 23.

In FIG. 6 the top end of the tether 4 carries an abutment 24 fixed to the tether and 25 denotes turnbuckle devices constituting variable spacers interposed between the abutment 24 and the platform 1.

In practice, the temporary catenary cables are left in place then when at least one mooring tether is installed at each corner of the platform and is believed to have connected properly at the bottom end to the anchorage 3 on the sea bed gas is admitted from the bottles 14 to the accumulators 13 and pressing on the free pistons 22 communicates its pressure to the liquid below the pistons 22 and thus to the liquid in the cylinder 12. The pressure of the liquid forces the piston 20 to move upwardly and apply a tensioning force to the mooring tether against the platform 1. An immediate indication is provided as to whether or not the tether has stabbed on to the anchorage 5 on the sea bed because if proper stabbing on has taken place the pressure of the operating liquid will show a rapid rise because of the resistance encountered by the piston 20 from the anchored mooring tether. Little or no rise of pressure indicates that the tether is not connected to its anchorage on the sea bed and a fresh anchoring operation must be undertaken then. If the anchorage has been properly made the resistance encountered by the piston 20 causes a downward force to be exerted on the platform 1. This force fluctuates because of the floating movement of the platform which occurs almost continuously in an uncontrolled platform because of wave motion. When the tensioning load is first applied by the gas-operated tension spring device to the mooring tether in the action of depressing the platform the spring device has a low rate and the platform can move substantially freely vertically in conformity with the wave motion. For the process of tensioning the mooring tether the rate of the spring device is increased by cutting out one gas bottle after another by closure of one valve 23 after another. The reduced air volume as each bottle is cut out has the effect of increasing the pressure rise for each upward movement of the platform because the upward movement of the platform causes a relatively downward movement of the piston 20 and a consequent flow of liquid into the accumulator cylinders 13 so that the pistons 22 rise and increase the gas pressure since the volume of gas for compression is decreased as each gas bottle is isolated. This operation is continued until the spring rate is so high that the platform is brought to rest or to a degree of movement considered acceptable. Alternatively or additionally another source of gas at high pressure may be brought into use thereby augmenting the spring force between the tether and the platform. When this state is reached the mooring tether is stressed to the desired value. The valve 16 is then closed creating a hydraulic lock in the cylinder 12. The nut 11 is thereupon moved down the screw-threaded section 7 until it engages the adjustor nut adaptor 10 and provides a mechanical lock. This maintains the desired tension in the mooring tether sufficient to hold the platform in its present depressed position against the sea forces acting on it. The gas-operated tension spring device and its associated equipment may then be removed from the mooring tether after relieving the pressure in the hydraulic system. The tensioning action is performed simultaneously on at least one tether at each corner of the platform. The other tethers at each corner may then be simply stressed to the same extent for example by applying the gas-operated tension spring device to each in turn or by applying other gas-operated tension spring devices to each in turn or other jacking devices to stress the other tethers, the correct degree of stress being obtained from the associated load cells, then tightening their adjustor nuts against the seats on the corresponding adjustor nuts. Finally the gas-operated tension spring devices may be removed. Platform resonance during particular sea conditions may be avoided or reduced by operating the tensioning mechanism sufficiently rapidly as the critical natural frequency of the platform is approached during the existence of such conditions.

In the construction of FIG. 6 after the platform 1 has been depressed to the desired extent and the tether 4 is tensioned to the appropriate extent all as already described the variable spacers constituted by the turnbuckles 25 are extended to function as rigid distance pieces between the abutment 24 on the tether 4 and the platform 1. The gas-operated tension spring device may then be removed.

I claim:

1. A mooring tether arranged to be connected between a floating oil platform and an anchorage on the sea bed incorporating a tether member, a connector fitted to one end of the tether member and arranged to be connected to an anchorage on the sea bed, a screw-threaded section attached to the other end of the tether member, an adjustor nut movable along the screw-threaded section, an adjustor nut adaptor penetrated by the screw-threaded section and supported on the platform, and a gas-operated tension spring device coupled to the upper end of the screw-threaded section and arranged to apply an elastic tensile force between the upper end of the tether and the platform.

2. A mooring tether arranged to be connected between a floating oil platform and an anchorage on the sea bed incorporating a tether member, a connector fitted to one end of the tether member and arranged to be connected to an anchorage on the sea bed, a fixed abutment attached to the other end of the tether member, at least one variable spacer device interposed between the fixed abutment and the platform, said spacer device being arranged to be capable of maintaining a chosen spaced relationship between the top of the tether and the platform, and a gas-operated tension spring device coupled to the upper end of the tether member and arranged to apply an elastic tensile force between the upper end of the tether and the platform.

3. A mooring tether as claimed in claim 1 or claim 2 in which means is provided for varying the rate of the tension spring device, i.e. the ratio between the tensile force exerted by the device and any particular extended length of the device.

4. A mooring tether as claimed in claim 1 or claim 2 in which the gas-operated tension spring device incorporates an operating cylinder, a piston slidable in the cylinder, a piston rod attached to the piston and projecting from one end of the cylinder, said projecting end being connected to the upper end of the tether, at least one accumulator cylinder in communication with said end of the cylinder from which the piston projects, said end of the cylinder being filled with operating liquid and the accumulator cylinder also containing operating liquid, valve means controlling the flow of operating liquid between the operating cylinder and the accumulator cylinder and a source of gas supply at a pressure above atmospheric and of finite volume connected to the part of the accumulator cylinder above liquid level so that the gas pressure is supplied to the upper surface of the operating liquid in said accumulator cylinder and thus to the liquid in the operating cylinder.

5. A mooring tether as claimed in claim 4 in which the gas supply is divided into a high pressure gas supply and a low pressure gas supply alternatively connectible to the accumulator cylinder.

6. A mooring tether as claimed in claim 4 in which means is provided for varying the gas pressure.

* * * * *